US005957647A

United States Patent [19]

Hinton

[11] Patent Number: 5,957,647

[45] Date of Patent: Sep. 28, 1999

[54] CONTAINERS

[75] Inventor: Peter James Hinton, Wiltshire, United Kingdom

[73] Assignee: Carnaudmetalbox (Holdings) USA, Inc., Wilmington, Del.

[21] Appl. No.: 08/930,640

[22] PCT Filed: Mar. 13, 1996

[86] PCT No.: PCT/GB96/00579

§ 371 Date: Dec. 4, 1997

§ 102(e) Date: Dec. 4, 1997

[87] PCT Pub. No.: WO96/31302

PCT Pub. Date: Oct. 10, 1996

[30] Foreign Application Priority Data

Apr. 4, 1995 [GB] United Kingdom ..... 9506962

[51] Int. Cl.[6] ..... B21D 51/32

[52] U.S. Cl. ..... 413/4; 413/6; 413/27

[58] Field of Search ..... 413/6, 4, 31, 36, 413/27, 26

[56] References Cited

U.S. PATENT DOCUMENTS

| | | | |
|---|---|---|---|
| 1,827,545 | 10/1931 | Schroeder . | |
| 3,556,031 | 1/1971 | Frankenberg | 413/27 X |
| 4,470,738 | 9/1984 | Togo et al. | 413/6 X |
| 4,606,205 | 8/1986 | Segredo et al. | 413/27 X |
| 4,777,831 | 10/1988 | Masuda | 413/27 X |
| 5,066,184 | 11/1991 | Taura et al. | 413/6 X |

FOREIGN PATENT DOCUMENTS

| | | |
|---|---|---|
| 0065842 | 12/1982 | European Pat. Off. . |
| 62-227726 | 10/1987 | Japan . |
| 63-281721 | 11/1988 | Japan . |
| 2121332 | 12/1983 | United Kingdom . |

*Primary Examiner*—James F. Coan
*Attorney, Agent, or Firm*—Diller, Ramik & Wight, PC

[57] ABSTRACT

The invention is directed to a method of manufacturing a double seam joining a can end (2) to a can body (1) which includes a sidewall (13) terminating in an outwardly directed flange (16) having a flange angle (α) within the range of 0 to −45°. During the support of the can end (2) upon the flange (16) of the can body, seeming rolls (37, 38) form a double seam while an axial load of 600N or less is applied to force the can end and the can body one against the other.

16 Claims, 4 Drawing Sheets

CONTAINERS

BACKGROUND OF THE INVENTION

This invention relates to the forming of a double seam between an end wall of a can and a body of a can.

Wall ironed can bodies commonly have a bottom wall and an integral side wall upstanding from the periphery of the bottom wall to terminate in a shoulder, a neck of reduced diameter, and an outwardly directed flange. It is usual for the majority of the side wall to be much thinner than the bottom wall. An annulus of arcuate cross-section connects the neck to the flange, and a typical radius of this arcuate annulus is 0.040". Wall ironed can bodies are usually coated internally after forming by sprayed lacquer. Can ends fitted to these wall ironed can bodies are stamped from precoated sheet metal such as tinplate, electrochrome coated steel (TFS), or aluminium alloy.

The can industry is asked to provide a variety of features on the sidewall of the can, such as texturing or can sidewall shaping, which can result in the can having a reduced axial strength. Due to this reduced axial strength, there can be problems encountered during the seaming of the can end onto the can, which is typically carried out using an axial load of approximately 650N.

Accordingly there is provided a method of making a double seam joining a can body to a can end, the can body having a side wall terminating in an outwardly directed flange, said method comprising the steps of:

a) supporting the can body, b) applying a can end to the flange of the can body, c) applying a load to force the can end and the can body one against the other, d) applying one or more operation seaming rolls to a peripheral curl of the can end to progressively form a double seam by a relative rolling motion, characterised in that, e) the flange angle (as hereinafter defined) is within the range 0 to −450°, and f) the load applied between the can end and the can body is 600N or less.

Alternatively, there is provided a method of joining a can body to a can end with a double seam, the method comprising the steps of:

a) forming an outwardly directed flange on the peripheral edge of the side wall of the can body, b) supporting the can body, c) applying a can end to the flange of the can body, d) applying a load to force the can end and the can body one against the other, e) applying one or more operation seaming rolls to a peripheral end of the can end to progressively form a double seam by a relative rolling motion, characterised in that:

f) the flange angle angle (as hereinafter defined) is within the range 0 to −45°, and g) the load applied between the can end and the can body is 600N or less.

The term "flange angle" is well known in the can making art and comprises the angle between the flange and the horizontal, assuming the can is standing upright. Typical conventional cans have a positive flange angle between 0 and 15° (i.e. they are either horizontal or "point upwards" at an angle of up to 15°). Cans with a negative flange angle (i.e. with a downwardly pointing flange) are known as having a "mushroom flange", and this is seen as being a flange defect produced by poor can making practices. U.S. Pat. No. 3,556,031 discloses a seaming technique which uses a downwardly directed can flange but this is a technique using a cam surface, rather than the double operation seaming roll technique which has become the industry's standard.

SUMMARY OF THE INVENTION

Applicants have discovered that when a can is formed having a flange with a negative flange angle in the range described, acceptable double seams can be formed using a much lower axial load during the seaming operation. This is a feature which is not suggested by U.S. Pat. No. 3556031, and has not previously been recognised with previously formed "mushroom" flanges. According to the present invention the load applied between the can end and the can body during seaming is typically in the range 200N–600N, conveniently 400N or less, and conceivably even 200N or less. This reduced axial load during seaming may allow shaped or patterned cans to be seamed which would otherwise risk collapsing during a conventional seaming process.

Conveniently the flange angle of the can flange is in the range −4° to −42.5°, and preferably in the range −10° to −40°. The flange radius (which is a term of art in the can making industry meaning the length of the flange during its curvature outwardly from the neck of the can) is conveniently greater than 0.55 mm (0.0217") and preferably in the range 0.75 mm (0.030") to 1.15 mm (0.045").

The invention also extends to a can body having an outwardly directed flange at the peripheral edge of the side wall thereof, characterised in that the flange has a flange angle within the range 0 to −45°, a flange radius within the range 0.75 mm (0.030") to 1.15 mm (0.045"), and a flange fibre length (as hereinafter defined) within the range 3.22 mm (0.127") to 4 mm (0.157"). The flange fibre length is hereindefined as the length to the end of the flange from a point 1.4 mm (0.055") below the top of the can body when in an upright position. The flange fibre length therefore consists of part of the neck portion of the can body, the flange radius, and the flange length (the straight portion from the flange radius to the end of the flange).

Embodiments of the invention will now be further described by way of example only, with reference to the accompanying drawings, in which:

BRIEF DESCRIPTION OF THE DRAWINGS

FIG. 1 shows a conventional wall ironed can body 1 with a can end 2 located on the can body in readiness for forming a double seam using forces available from the apparatus 3 as shown, or known apparatus working on the same principles.

DESCRIPTION OF THE PREFERRED EMBODIMENTS

Figure 1:
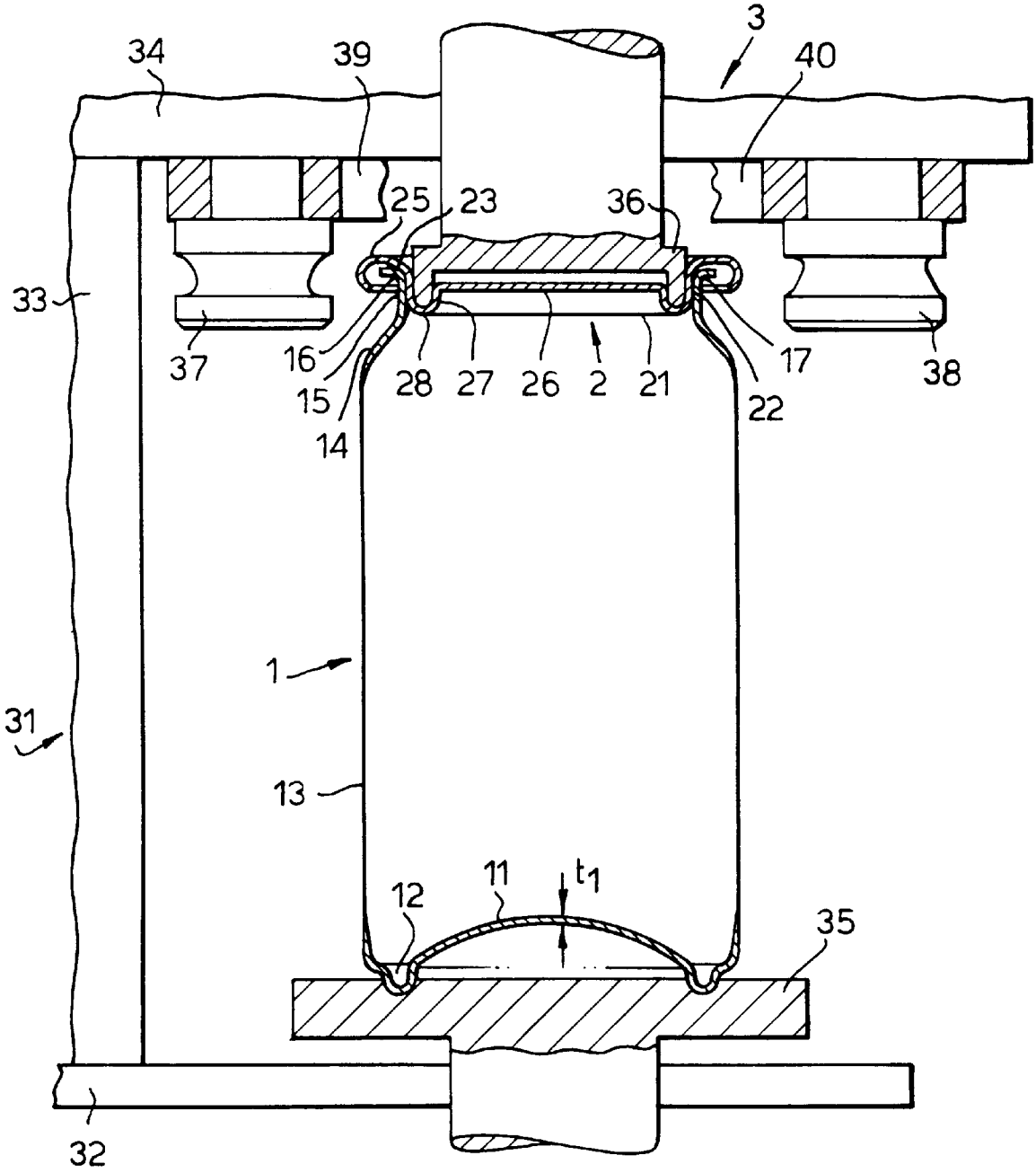
FIG. 1 is a diagrammatic sketch of conventional apparatus for forming a double seam joining a can end to a can body.

In FIG. 1 the can body has been drawn and wall ironed from a single metal blank to comprise a domed bottom wall 11 including a stand bead 12, and a sidewall 13 thinner than the bottom wall. The sidewall 13 extends from the periphery of the bottom wall to a shoulder portion 14 which itself extends inwardly and upwardly to a neck 15 of reduced diameter. The neck 15 terminates in an outwardly extending flange 16 joined to the neck by a flange radius 17 of radius $r_1$.

Typically the can body is drawn from a circular blank tinplate 0.010" thick or of a aluminium alloy 0.012" thick. The thinnest part of the side wall is usually about half the thickness of the bottom wall. The side wall thickness increases in the shoulder 14 portion to a thickness of about 0.008" in the neck and flange. The flange radius $r_1$ is typically in the range 0.040" to 0.050". Such can bodies are widely used for the packaging of beverages.

The can end 2 was drawn from a coated sheet metal blank to comprise a centre panel 21, a chuck wall 22 upstanding from the periphery of the centre panel, a seaming panel radius 23 extending outwardly from the centre panel, and a peripheral curl 25 of externally convex cross-section surrounding the seaming panel radius. As shown, the centre panel has a raised centre panel portion 26, a panel wall 27 depending from the periphery of the central panel portion, and a reinforcing bead 28 which joins the panel wall to the chuck wall 22. Such can ends are commonly used to close can bodies containing carbonated beverages. Whilst described with reference to beverage cans and can ends this invention relates to improvements in the double seam which may be alternatively used for other cans such as food cans in which the centre panel comprises concentric expansion panels (not shown). Beverage can ends are typically formed from aluminium alloy sheet about (0.010") thick or tinplate or TFS about 0.009" thick.

In FIG. 1 the apparatus 3 for forming a double seam has a frame 31 comprising a base plate 32, an upright portion 33 upstanding from the base plate, and a top plate 34 extending over the base plate. A lifter pad 35 is slidably mounted in the base plate 32 and, as shown, supports the can body 1 in axial alignment with a chuck 36 slidably mounted on the top plate 34, and at the level of the seam forming profiles of a first operation roll 37 and a second operation roll 38.

Figure 2:
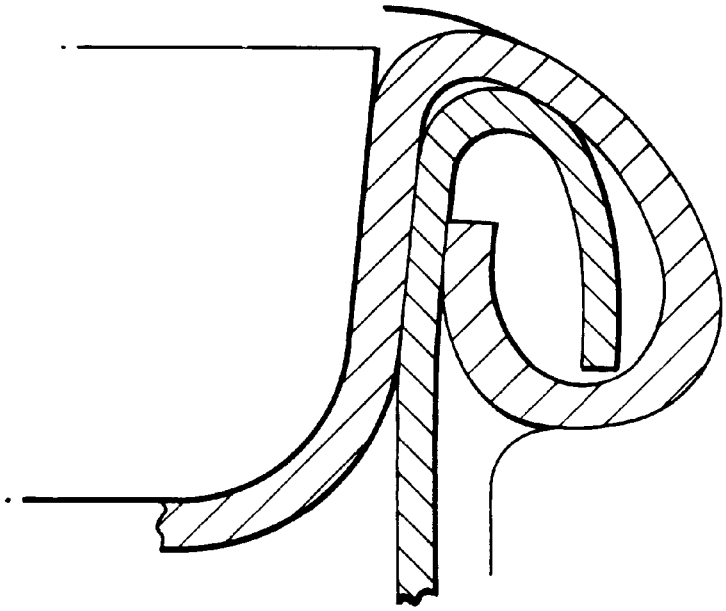
FIG. 2 is a fragmentary section showing the can end and can body flange after the forming of a first forming operation of a conventional double seam.
Figure 3:
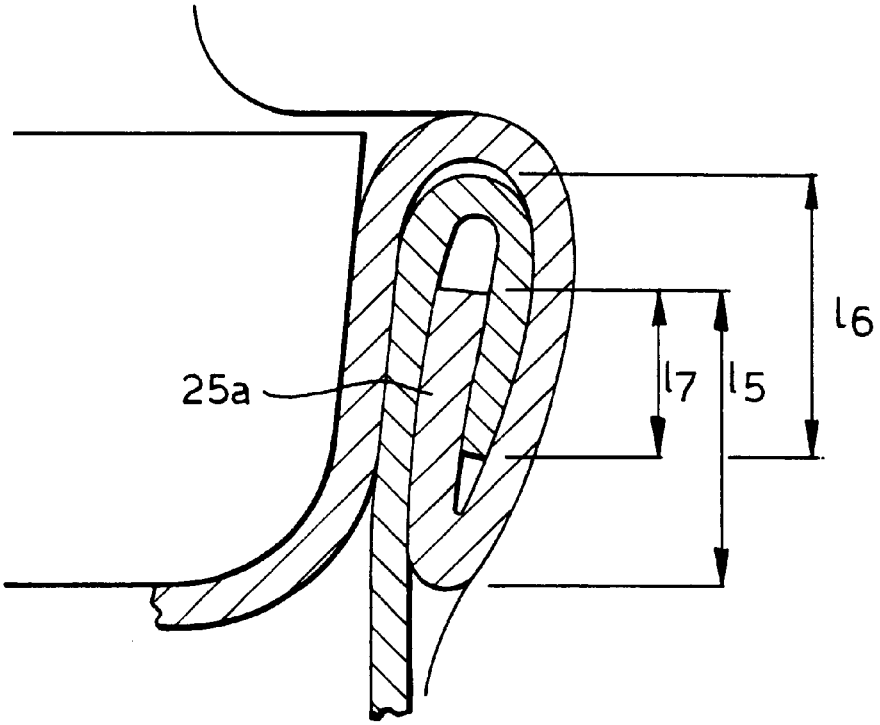
FIG. 3 is a fragmentary section showing the can end and can body flange after the forming of a second and final forming operation of a conventional double seam.

The first operation roll 37 is mounted for free rotation on a lever 39 which is driven by a cam (not shown) to bring the roll 37 into engagement with the can end to form a first operation seam shown in FIG. 2. The second operation roll 38 is mounted for free rotation on a lever 40 which is driven by a cam (not shown) to bring the second operation roll 38 into engagement with the first operaton seam to form a completed seam as shown in FIG. 3. In most double seaming apparatus the can body and end rotate as the rolls 37, 38 progressively form the double seam. Therefore the forces available to form a double seam by relative rolling motion as between the can end on a can body and rolls or rails are:

a) bottom pressure applied between the lifter pad and chuck, to centre the can end firmly on the body flange and;

b) lateral pressure applied in an inwardly radial directon by the rolls or rail.

During wall ironing of the can body the metal of the neck and flange is ironed and finished by necking to about 0.007" thick so that application of excessive top pressure to the can end puts the body neck and flange at risk of a hoop stretching force as the exterior surface of the can end is pushed firmly onto the body flange radius 17.

During the seaming operation, it can sometimes be experienced that the body flange is not fully formed to the length necessary to achieve a satisfactory length of overlap $l_7$ of the body flange and curl extremity or coverhood 25*a*. In the past, attempts to correct this short overlap required application of a greater base pressure to the can during double seaming. However, this brings a risk of distortion of the can body flange and a risk of crushing the thin side wall metal of the can body, so that maximum economy of metal usage in the body has not been exploited.

Figure 5:
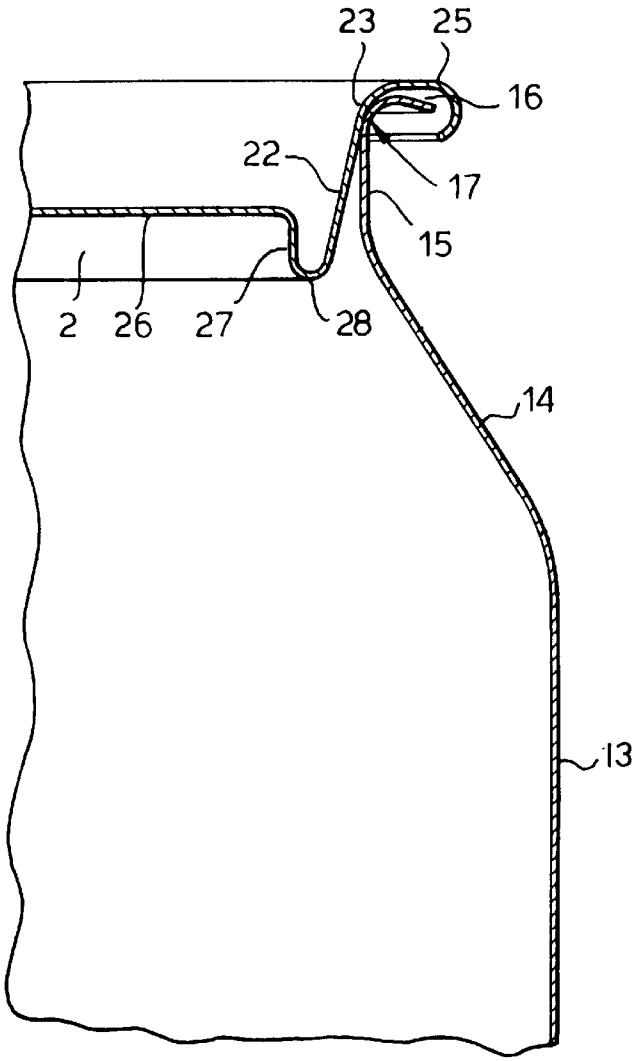
FIG. 5 is a sectional side view showing a can end and a can body in accordance with the present invention.
Figure 4:
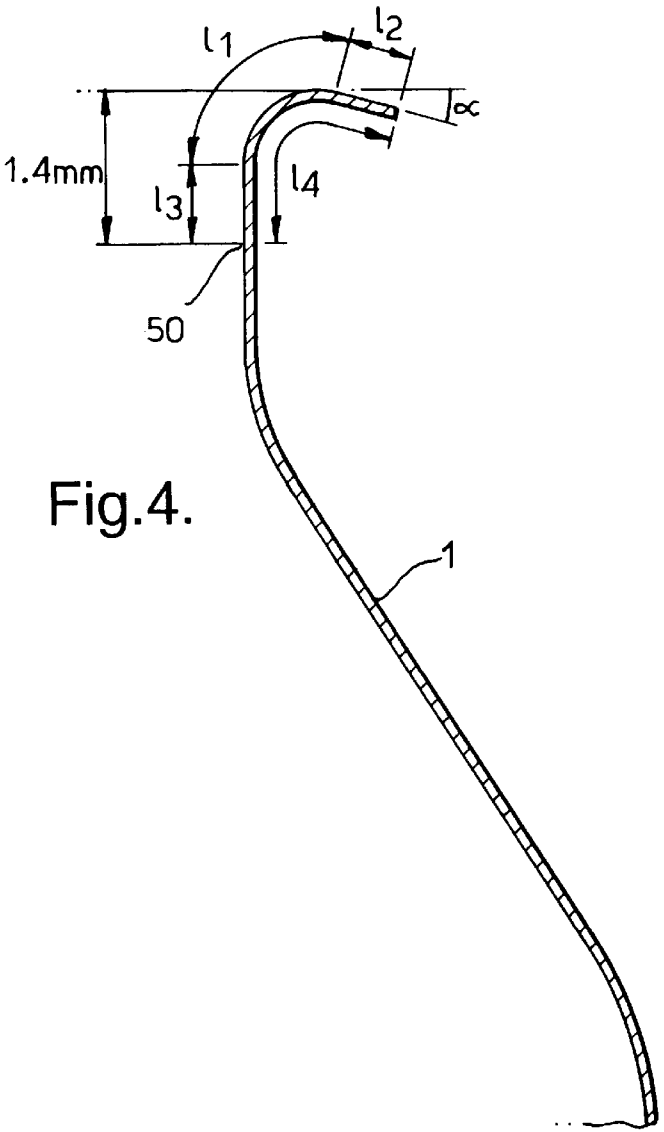
FIG. 4 is a sectional side view showing a portion of a can body in accordance with the present invention.

The FIGS. 4 and 5 show a can body according to the present invention with a flange having a downwardly disposed flange so as to give a flange angle a of approximately −12.5°. In FIG. 4 the flange radius is denoted as $l_1$, the flange length as $l_2$ and the neck portion (from the beginning of the flange radius to a point 50 at a position 1.4 mm (0.055") below the top of the can body) as $l_3$. The flange fibre length $l_4$ (from the point 50 the end of the flange) is therefore $l_1+l_2+l_3$.

Can bodies similar to those of FIGS. 4 and 5 were produced with flange angles ranging from 0 to −42.5°. Can ends were double seamed onto the can bodies using the equipment of FIG. 1, with the base pressure of the apparatus set at 600N, 400N and 200N respectively. Acceptable double seams were produced at these lower than normal base pressures, and features such as the end hook length $l_5$, body hook length $l_6$, overlap $l_7$ (see FIG. 3), flange angle $\alpha$ and flange fibre length $l_4$ were measured. The results are presented in Tables 1 to 3 respectively. The trials show that by using can bodies with a downwardly directed flange having a flange angle $\alpha$ within the above range, acceptable double seams can be achieved using axial loads well below the 650N conventionally used in the can making industry.

Figure 6:
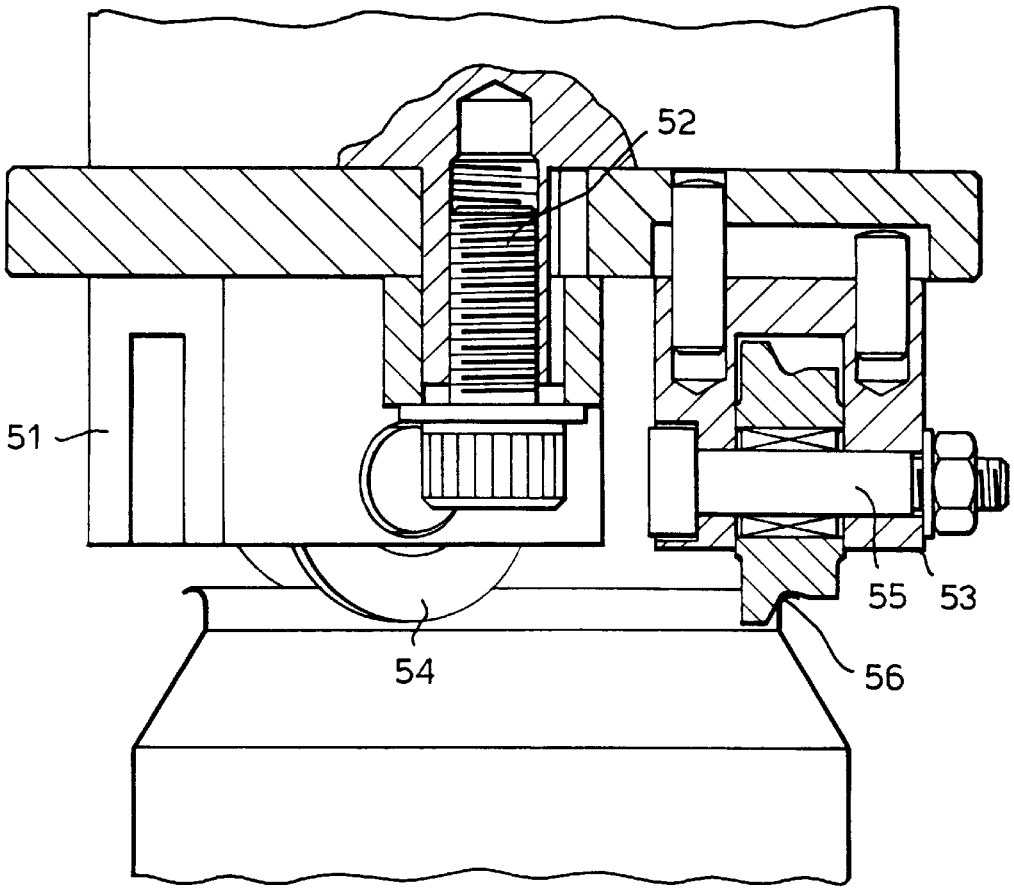
FIG. 6 is a sectional side view showing apparatus for forming a flange on a can body in accordance with the present invention and FIG. 7 an underneath view of the apparatus of FIG. 6.
Figure 7:
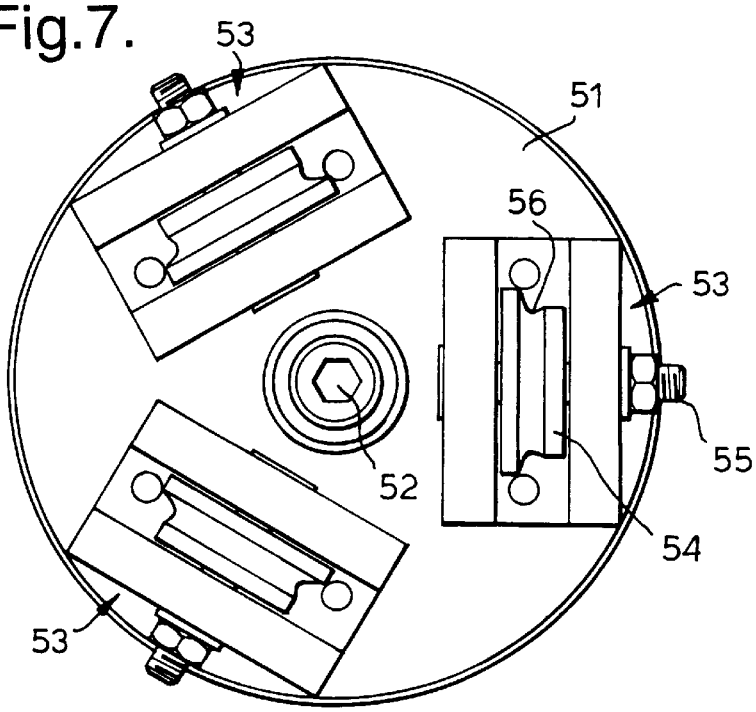

FIGS. 6 and 7 show apparatus suitable for forming the downwardly extended flanges associated with the present invention. The apparatus comprises a tooling head 51 rotatable on a central drive shaft 52. Depending from the head 51 are three roller assemblies 53, each of which comprises a shaped roller 54 mounted for rotation on a spindle 55. Each roller 54 has a shaped contact surface 56 designed to produce a downwardly turned flange 16 as the rotating rollers are brought downwardly into contact with the top peripheral portion of a can body 1.

TABLE 1

| | SEAMER SETTING LOAD: 600N | | | | | |
|---|---|---|---|---|---|---|
| Tooling Description | Flange Angle | Flange Radius | Flange Fibre Length | End Hook | Body Hook | Overlap |
| Std Can | 6.3 | 45.3 | 119.9 | 64.0 | 66.5 | 43.3 |
| 1.5 mm die | −4.0 | 43.3 | 127.0 | 63.0 | 68.3 | 49.5 |

TABLE 1-continued

| SEAMER SETTING LOAD: 600N | | | | | | |
|---|---|---|---|---|---|---|
| Tooling Description | Flange Angle | Flange Radius | Flange Fibre Length | End Hook | Body Hook | Overlap |
| 1.5 mm die | −12.5 | 35.4 | 136.8 | 64.3 | 70.3 | 49.5 |
| 1.5 mm die | −27.5 | 33.5 | 148.8 | 64.3 | 69.5 | 47.0 |
| 1.5 mm die | −42.5 | 31.5 | 157.3 | 59.5 | 68.5 | 41.3 |
| 1.0 mm die | 0.0 | 45.3 | 126.1 | 63.3 | 67.3 | 46.0 |
| 1.0 mm die | −3.5 | 41.3 | 129.2 | 66.0 | 69.5 | 50.0 |
| 0.5 mm die | −20.0 | 37.4 | 136.7 | 63.3 | 68.5 | 47.0 |
| 0.5 mm die | −6.5 | 37.4 | 110.1 | 64.8 | 68.5 | 47.8 |
| Spin flange | 8.5 | 51.2 | 128.5 | 63.0 | 67.5 | 46.3 |
| Spin flange | 10.0 | 49.2 | 131.4 | 61.3 | 70.8 | 48.8 |
| Rolled | −14.0 | 27.6 | 138.1 | 65.0 | 71.5 | 50.3 |
| Rolled | −22.5 | 21.7 | 146.1 | 64.3 | 70.3 | 48.0 |

(all dimensions in thou.)

TABLE 2

| SEAMER SETTING LOAD: 400N | | | | | | |
|---|---|---|---|---|---|---|
| Tooling Description | Flange Angle | Flange Radius | Flange Fibre Length | End Hook | Body Hook | Overlap |
| Std Can | 6.3 | 45.3 | 119.9 | 65.0 | 64.5 | 41.8 |
| 1.5 mm die | −4.0 | 43.3 | 127.0 | 64.3 | 66.3 | 46.0 |
| 1.5 mm die | −12.5 | 35.4 | 136.8 | 64.5 | 66.3 | 46.5 |
| 1.5 mm die | −27.5 | 33.5 | 148.8 | 64.0 | 68.5 | 47.0 |
| 1.5 mm die | −42.5 | 31.5 | 157.3 | 63.3 | 68.5 | 44.8 |
| 1.0 mm die | 0.0 | 45.3 | 126.1 | 63.5 | 63.5 | 43.5 |
| 0.5 mm die | −20.0 | 37.4 | 136.7 | 64.3 | 61.8 | 42.0 |
| 0.5 mm die | −6.5 | 37.4 | 110.1 | 63.8 | 64.0 | 43.5 |
| Spin flange | 8.5 | 51.2 | 128.5 | 62.5 | 63.8 | 43.0 |
| Spin flange | 10.0 | 49.2 | 131.4 | 63.3 | 70.0 | 48.5 |
| Rolled | −14.0 | 27.6 | 138.1 | 64.8 | 68.0 | 48.3 |
| Rolled | −22.5 | 21.7 | 146.1 | 63.8 | 68.5 | 47.0 |

TABLE 3

| SEAMER SETTING LOAD: 200N | | | | | | |
|---|---|---|---|---|---|---|
| Tooling Description | Flange Angle | Flange Radius | Flange Fibre Length | End Hook | Body Hook | Overlap |
| Std Can | 6.3 | 45.3 | 119.9 | 65.3 | 55.8 | 33.8 |
| 1.5 mm die | −4.0 | 43.3 | 127.0 | 63.5 | 61.5 | 39.5 |
| 1.5 mm die | −12.5 | 35.4 | 136.8 | 65.0 | 64.8 | 45.3 |
| 1.5 mm die | −27.5 | 33.5 | 148.8 | 63.0 | 65.5 | 42.8 |
| 1.5 mm die | −42.5 | 31.5 | 157.3 | 62.0 | 66.0 | 41.3 |
| 1.0 mm die | 0.0 | 45.3 | 126.1 | 65.3 | 57.8 | 37.3 |
| 1.0 mm die | −3.5 | 41.3 | 129.2 | 66.5 | 63.5 | 45.5 |
| 0.5 mm die | −20.0 | 37.4 | 136.7 | 63.5 | 60.5 | 40.5 |
| 0.5 mm die | −6.5 | 37.4 | 110.1 | 63.3 | 57.0 | 36.3 |
| Spin flange | 8.5 | 51.2 | 128.5 | 64.8 | 58.8 | 38.8 |
| Spin flange | 10.0 | 49.2 | 131.4 | 65.0 | 60.0 | 40.0 |
| Rolled | −14.0 | 27.6 | 138.1 | 64.5 | 64.5 | 44.8 |
| Rolled | −22.5 | 21.7 | 146.1 | 64.0 | 66.8 | 45.3 |

Those skilled in the art will appreciate that other equipment capable of producing the downwardly facing flanges associated with the present invention can readily be employed.

The present invention provides the advantage that, by redesigning the flange of a can body in a way more normally thought of as a can making defect, acceptable double seaming of can ends onto can bodies can be achieved using axial loadings considerably lower than conventionally used. This affords opportunities for can lightweighting, as well as surface features such as sidewall shaping and patterning mentioned earlier. Although the above description has been made with reference to beverage cans, it will be appreciated by those skilled in the art that the present invention will equally be applicable to food cans. Indeed, as the use of a downwardly facing flange causes less damage to the seaming compound during the formation of a double seam, the present invention may allow alternative seaming compounds to be employed, and possibly even alternative materials for the can end itself. Although a preferred embodiment of the invention has been specifically illustrated and described herein, it is to be understood that minor variations may be made in the apparatus without departing from the spirit and scope of the invention, as defined the appended claims.

What is claimed is:

1. A method of making a double seam joining a can body (1) to a can end (2), the can body having a sidewall (13) terminating in an outwardly directed flange (16), the flange angle (α) being within the range 0 to −45°, said method comprising the steps of:

a) supporting the can body (1), b) applying a can end (2) to the flange (16) of the can body, c) applying one or more operation seaming rolls (37, 38) to a peripheral end of the can end to progressively form a double seam by a relative rolling motion, characterised in that:

d) an axial load is applied to force the can end and the can body one against the other, and e) the axial load applied between the can end and the can body is 600N or less.

2. A method according to claim 1, characterised in that the flange radius (17) is in the range 0.75 mm (0.030") to 1.15 mm (0.045").

3. A method according to claim 1, characterised in that the flange angle (α) is in the range −4° to −42.5°.

4. A method according to claim 1, characterised in that the flange angle (α) is in the range −10° to −40°.

5. A method according to claim 1, characterised in that the load applied between the can end (2) and the can body (1) is in the range 200N to 600N.

6. A method according to claim 1, in that the load applied between the can end (2) and the can body (1) is in the range 400N or less.

7. A method according to claim 1, in that the load applied between the can end (2) and the can body (1) is in the range 200N or less.

8. A method according to claim 1, chacterised in that the flange radius (17) is greater than 0.55 mm (0.0217").

9. A method of joining a can body (1) to a can end (2) with a double seam, the method comprising the steps of:

a) forming an outwardly directed flange (16) on the peripheral edge of the sidewall of the can body, the flange angle (α) being within the range 0 to −45°, b) supporting the can body (1), c) applying a can end (2)to the flange (16) of the can body, d) applying one or more operation seaming rolls (37, 38) to a peripheral end of the can end to progressively form a double seam by a relative rolling motion, characterised in that, e) an axial load is applied to force the can end and the can body one against the other, and f) the axial load applied between the can end and the can body is 600N or less.

10. A method according to claim 9, characterised in that the flange angle (α) is in the range −4° to −42.5°.

11. A method according to claim 9, characterised in that the flange angle (α) is in the range −10° to −40°.

12. A method according to claim 9, characterised in that the load applied between the can end (2) and the can body (1) is in the range 200N to 600N.

13. A method according to claim 9, in that the load applied between the can end (2) and the can body (1) is in the range 400N or less.

14. A method according to claim 9, in that the load applied between the can end (2) and the can body (1) is in the range 200N or less.

15. A method according to claim 9, characterised in that the flange radius (17) is greater than 0.55 mm (0.0217").

16. A method according to claim 9, characterised in that the flange radius (17) is in the range 0.75 mm (0.030") to 1.15 mm (0.045").

* * * * *